US008998104B2

(12) United States Patent
Burkhardt et al.

(10) Patent No.: US 8,998,104 B2
(45) Date of Patent: Apr. 7, 2015

(54) INJECTION VALVE

(75) Inventors: Axel Burkhardt, Mühlhacker (DE); Robert Kuchler, Regen (DE); Joachim Wagner, Dietfurt a. d. Altmühl (DE); Roland Wild, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 393 days.

(21) Appl. No.: 13/505,662

(22) PCT Filed: Nov. 3, 2010

(86) PCT No.: PCT/EP2010/066739

§ 371 (c)(1),
(2), (4) Date: Jul. 17, 2012

(87) PCT Pub. No.: WO2011/054869

PCT Pub. Date: May 12, 2011

(65) Prior Publication Data

US 2013/0126636 A1 May 23, 2013

(30) Foreign Application Priority Data

Nov. 3, 2009 (DE) ..... 10 2009 051 677

(51) Int. Cl.
*F02M 39/00* (2006.01)
*F02M 47/02* (2006.01)
(Continued)

(52) U.S. Cl.
CPC ..... *F02M 47/02* (2013.01); *F02M 47/027* (2013.01); *F02M 61/167* (2013.01);
(Continued)

(58) Field of Classification Search
USPC ..... 239/299, 446, 447, 467, 468, 569, 584, 239/585.1, 585.2, 585.3, 585.5, 533.1, 239/533.2, 533.3, 533.7, 533.13
See application file for complete search history.

(56) References Cited

U.S. PATENT DOCUMENTS 3,839,943 A 10/1974 Ufnalewski ..... 91/454
4,125,226 A * 11/1978 Nieuwkamp ..... 239/468
(Continued)

FOREIGN PATENT DOCUMENTS

DE 102005015409 A1 10/2006 ..... F02M 51/06
DE 102006014246 A1 10/2007 ..... F02M 47/02
(Continued)

OTHER PUBLICATIONS

International PCT Search Report and Written Opinion, PCT/EP2010/066739, 11 pages, Feb. 8, 2011.

*Primary Examiner* — Len Tran
*Assistant Examiner* — Juan C Barrera
(74) *Attorney, Agent, or Firm* — King & Spalding L.L.P.

(57) ABSTRACT

An injection valve includes an injector component having an injector body including a recess hydraulically coupled to a high-pressure circuit of a fluid, and a nozzle needle moveably disposed injector body recess for preventing fluid flow through at least one injection opening in a closed position, and otherwise for releasing the fluid flow; an actuator unit disposed in the injector body recess and having an actuator element disposed in an actuator housing including an end face at an axial end facing the injection opening, which end face is mechanically coupled to a stage implemented in the injector body via a ring element disposed axially between the end face and the stage. At least two radial through passages are disposed opposite each other in the ring element, designed for hydraulically coupling between a ring interior disposed within the ring element and a ring exterior disposed outside of the ring element.

15 Claims, 3 Drawing Sheets

(51) Int. Cl.
*F02M 61/16* (2006.01)
*F02M 63/00* (2006.01)

(52) U.S. Cl.
CPC ..... *F02M 63/0026* (2013.01); *F02M 2200/03* (2013.01); *F02M 2200/16* (2013.01); *F02M 2200/28* (2013.01); *F02M 2200/315* (2013.01)

(56) References Cited

U.S. PATENT DOCUMENTS

| | | | | |
|---|---|---|---|---|
| 6,237,570 | B1 | 5/2001 | Aoki et al. | 123/467 |
| 6,688,579 | B2 | 2/2004 | Grytz | 251/129.16 |
| 7,552,909 | B2 | 6/2009 | Ricco et al. | 251/129.18 |
| 2003/0015599 | A1* | 1/2003 | Carroll et al. | 239/88 |
| 2006/0138374 | A1 | 6/2006 | Lucas et al. | 251/129.16 |
| 2008/0060904 | A1* | 3/2008 | Nukata | 192/106 R |
| 2008/0257980 | A1 | 10/2008 | Magel | 239/89 |

FOREIGN PATENT DOCUMENTS

| | | | | |
|---|---|---|---|---|
| DE | 102007010497 | A1 | 9/2008 | F02M 47/02 |
| DE | 102007038430 | A1 | 2/2009 | F02M 47/02 |
| EP | 1845256 | A1 | 10/2007 | F02M 63/02 |
| WO | 02/053905 | A1 | 7/2002 | F02M 51/06 |

* cited by examiner

INJECTION VALVE

CROSS-REFERENCE TO RELATED APPLICATIONS

This application is a U.S. National Stage Application of International Application No. PCT/EP2010/066739 filed Nov. 3, 2010, which designates the United States of America, and claims priority to German Application No. 10 2009 051 677.8 filed Nov. 3, 2009, the contents of which are hereby incorporated by reference in their entirety.

TECHNICAL FIELD

This disclosure relates to an injection valve.

BACKGROUND

Ever more stringent legal regulations with regard to the admissible pollutant emissions of internal combustion engines which are arranged in motor vehicles make it necessary to implement various measures for reducing pollutant emissions. One approach here is to reduce the pollutant emissions generated by the internal combustion engine.

Correspondingly reduced pollutant emissions can be attained if the fuel is metered in at very high pressure. In the case of diesel internal combustion engines, the fuel pressures are up to over 2000 bar. Such high pressures place high demands on the construction of an injection valve. At the same time, high demands are placed on the actuator unit for the injection valve.

SUMMARY

In one embodiment, an injection valve comprises: an injector assembly with an injector body which has a recess, which extends in the direction of a longitudinal axis, of the injector body, which recess can be hydraulically coupled to a high-pressure circuit of a fluid, and with a nozzle needle arranged in an axially movable manner in the recess of the injector body, which nozzle needle is designed to prevent a fluid flow through at least one injection orifice when in a closed position and to otherwise permit the fluid flow; an actuator unit which is arranged in the recess of the injector body and which has an actuator housing in which an actuator element is arranged, and the actuator housing has, on an axial end facing towards the injection orifice, an end surface which is mechanically coupled to a step formed in the injector body; and a ring element arranged axially between the end surface and the step, wherein in the ring element there are arranged at least two passage orifices which are situated opposite one another and which extend radially and which are designed to provide hydraulic coupling between a ring interior space arranged within the ring element and a ring exterior space arranged outside the ring element.

In a further embodiment, at least one of the passage orifices is formed as a slot or groove in the ring element. In a further embodiment, the ring element has a multiplicity of passage orifices which are arranged point-symmetrically with respect to one another about the longitudinal axis. In a further embodiment, the ring element is formed as a hexagon with six sides, and one of the passage orifices is formed in each of the sides of the hexagon.

In another embodiment, an injection valve comprises: an injector assembly with an injector body which has a recess, which extends in the direction of a longitudinal axis, of the injector body, which recess can be hydraulically coupled to a high-pressure circuit of a fluid, and with a nozzle needle arranged in an axially movable manner in the recess of the injector body, which nozzle needle is designed to prevent a fluid flow through at least one injection orifice when in a closed position and to otherwise permit the fluid flow; an actuator unit which is arranged in the recess of the injector body and which has an actuator housing in which an actuator element is arranged, and the actuator housing has, on an axial end facing towards the injection orifice, an end surface which is mechanically coupled to a step formed in the injector body; and a ring element arranged axially between the end surface and the step, wherein in the step there is arranged at least one radially extending passage recess which is designed to provide hydraulic coupling between a ring interior space arranged within the ring element and a ring exterior space arranged outside the ring element.

In a further embodiment, in the step there is arranged a multiplicity of passage recesses which are arranged point-symmetrically with respect to one another about the longitudinal axis. In a further embodiment, at least one of the passage recesses is formed as a groove, as a channel, as an annular groove or as a hole in the step. In a further embodiment, the ring element is formed from a wire ring with a gap, wherein the gap is formed as a passage orifice

BRIEF DESCRIPTION OF THE DRAWINGS

Example embodiments will be explained in more detail below with reference to figures, in which.

DETAILED DESCRIPTION

Figure 1:
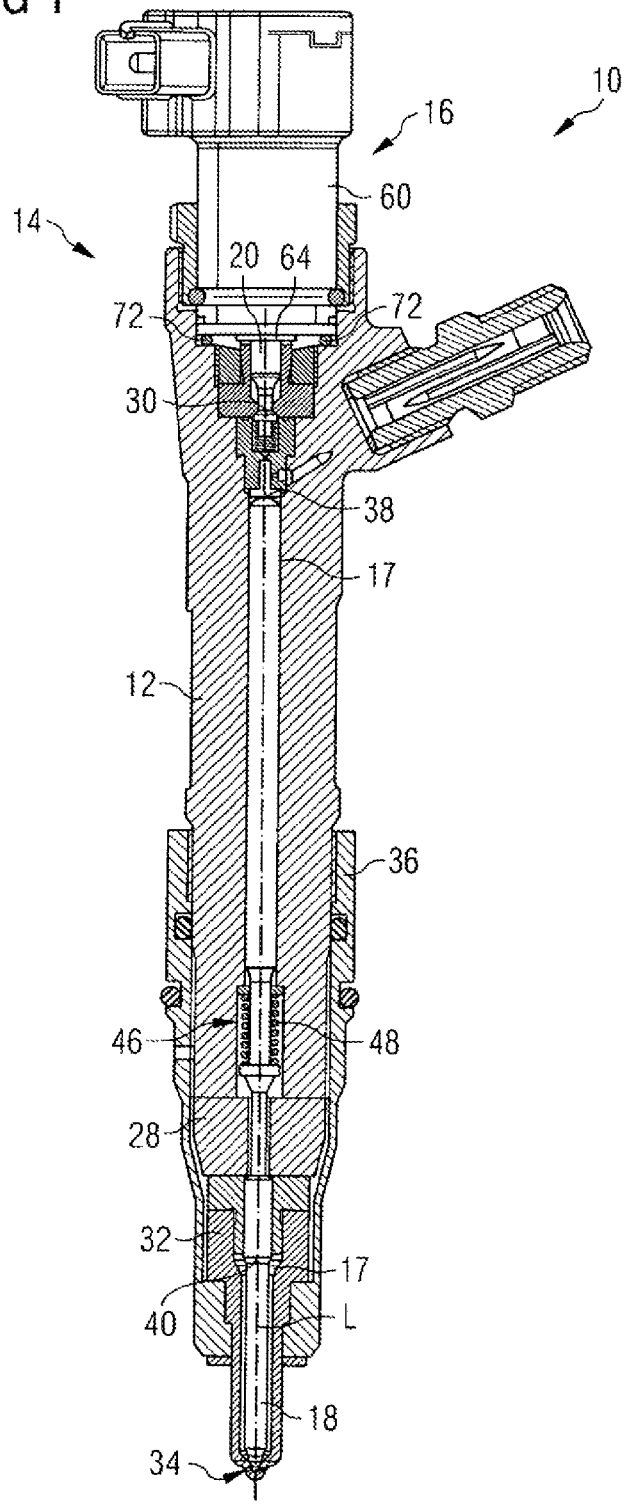
FIG. 1 shows a longitudinal section through an injection valve.

Some embodiments provide an injection valve which is simple and cheap to produce and the mechanical loading of which is limited.

According to a first embodiment, injection valve includes an injector assembly with an injector body which has a recess, which extends in the direction of a longitudinal axis, of the injector body, which recess can be hydraulically coupled to a high-pressure circuit of a fluid, and with a nozzle needle arranged in an axially movable manner in the recess of the injector body, which nozzle needle is designed to prevent a fluid flow through at least one injection orifice when in a closed position and to otherwise permit the fluid flow, an actuator unit which is arranged in the recess of the injector body and which has a tubular housing in which the actuator element is arranged, and the tubular housing has, on an axial end facing towards the injection orifice, an end surface which is mechanically coupled to a step formed in the injector body, and a ring element arranged axially between the end surface and the step. In the ring element there are arranged at least two passage orifices which are situated opposite one another and which extend radially and which are designed to provide hydraulic coupling between a ring interior space arranged within the ring element and a ring exterior space arranged outside the ring element.

An injection valve of such design may provide pressure equalization between the ring interior space and the ring exterior space. The pressure profiles in the ring interior space and the ring exterior space can therefore be aligned with one another. The dynamics of the pressure profile in the ring interior space and the ring exterior space can thereby be kept low. The mechanical loading resulting from pressure fluctuations in the injection valve and the loading of components of the injection valve can thereby be kept low.

In one embodiment, at least one of the passage orifices is formed as a slot or groove in the ring element. Such passage orifices may have the advantage of simple production. Furthermore, the ring element with the passage orifices can have high mechanical stability.

In a further embodiment, the ring element has a multiplicity of passage orifices which are arranged point-symmetrically with respect to one another about the longitudinal axis. This may provide pressure equalization between the ring interior space and the ring exterior space in a highly effective manner. It may thereby be possible for the pressure profiles in the ring interior space and the ring exterior space to be aligned with one another in a highly effective manner independently of the azimuth. The dynamics of the pressure profile in particular in the ring exterior space can thereby be kept low, such that the loading of components of the injection valve can be low.

In a further embodiment, the ring element is formed as a hexagon with six sides. One of the passage orifices is formed in each of the sides of the hexagon. Such ring element may be simple and inexpensive to produce. Furthermore, pressure equalization between the ring interior space and the ring exterior space may be possible in a highly effective manner. The pressure profiles in the ring interior space and the ring exterior space can thus be aligned in a highly effective manner.

According to another embodiment, an injection valve includes an injector assembly with an injector body which has a recess, which extends in the direction of a longitudinal axis, of the injector body, which recess can be hydraulically coupled to a high-pressure circuit of a fluid, and with a nozzle needle arranged in an axially movable manner in the recess of the injector body, which nozzle needle is designed to prevent a fluid flow through at least one injection orifice when in a closed position and to otherwise permit the fluid flow, an actuator unit which is arranged in the recess of the injector body and which has a tubular housing in which an actuator element is arranged, and the tubular housing has, on an axial end facing towards the injection orifice, an end surface which is mechanically coupled to a step formed in the injector body, and a ring element arranged axially between the end surface and the step. In the step there is arranged at least one radially extending passage recess which is designed to provide hydraulic coupling between a ring interior space arranged within the ring element and a ring exterior space arranged outside the ring element.

An injection valve of such design may provide pressure equalization between the ring interior space and the ring exterior space. The pressure profiles in the ring interior space and the ring exterior space can therefore be aligned with one another. The dynamics of the pressure profile in the ring interior space and the ring exterior space can thereby be kept low. The mechanical loading resulting from pressure fluctuations in the injection valve and the loading of components of the injection valve can thereby be kept low. Furthermore, the ring element can be formed without passage orifices and can have high mechanical stability.

In one embodiment, in the step there is arranged a multiplicity of passage recesses which are arranged point-symmetrically with respect to one another about the longitudinal axis. This may provide pressure equalization between the ring interior space and the ring exterior space in a highly effective manner. It may thereby be possible for the pressure profiles in the ring interior space and the ring exterior space to be aligned with one another in a highly effective manner independently of the azimuth.

In a further embodiment, at least one of the passage recesses is formed as a groove, as a channel, as an annular groove or as a hole in the step. Simple production of such passage recesses in the injector body may be possible.

In a further embodiment, the ring element is formed from a wire ring with a gap. The gap is formed as a passage orifice. Such ring element may be simple and inexpensive to produce.

FIG. 1 shows an example injection valve 10. The injection valve 10 has an injector assembly 14 with an injector body 12 and has an actuator unit 16 arranged in the injector body 12.

The actuator unit 16 is formed as a piezoelectric actuator with a stack of piezo elements. The axial extent of the actuator unit 16 varies as a function of the applied electrical voltage. The electrical voltage is applied to the actuator unit 16 via a connection socket.

The injector body 12 has a central longitudinal axis L and a recess 17. The injector body 12 may be of single-part or multi-part form. A nozzle needle 18 is arranged in the recess of the injector body 12. The nozzle needle 18 may be of single-part or multi-part form.

The actuator unit 16 is coupled to a transmitter 20 which is likewise arranged in the injector body 12. The actuator unit and the transmitter 20 form an actuating drive for the nozzle needle 18.

The injector body 12 furthermore comprises a high-pressure connection via which the injection valve 10 is, in the assembled state, connected to a high-pressure circuit (not illustrated) of a fluid.

A valve 30 which is coupled to the transmitter 20 is arranged in the recess 17 of the injector body 12.

The injection valve 10 furthermore comprises a nozzle body 32 which is coupled by means of a nozzle clamping nut 36 to the injector body 12. At the end facing away from the actuator unit 16, one or more injection orifices 34 are formed in the nozzle body 32.

The nozzle needle 18 has an end side 38 which faces toward the valve 30. At its end facing toward the actuator unit 16, the nozzle needle 18 has a nozzle needle shoulder 40 which is in contact with fluid which is approximately at the pressure of the high-pressure circuit. The nozzle needle shoulder 40 is formed such that the force caused by the pressure of the fluid acts so as to open the nozzle needle 18.

In the injector body 12 there is furthermore formed a cavity which receives a nozzle spring 48 which at one side is supported on a shoulder of the cavity 46 and which at the other side preloads the nozzle needle 18 such that the latter assumes a closed position assigned to it, in which closed position said nozzle needle prevents the fluid flow through the at least one injection orifice 34.

The functioning of the example injection valve 10 are discussed below:

The position of the nozzle needle 18 is dependent on the balance of forces exerted on the nozzle needle shoulder 40 and on the tip of the nozzle needle 18 by the pressure of the fluid, and secondly the spring force of the nozzle spring 48 and the force which is exerted by the pressure of the fluid and which is introduced in the closing direction of the nozzle needle 18 via the end side 38 of the nozzle needle 18.

As a result of activation of the actuator unit 16 which is formed as a piezoelectric actuator, the actuator unit 16 expands, such that the valve 30 opens and fluid can flow out of the chamber above the end side 38 of the nozzle needle 18. The nozzle needle 18 can thereby move in the direction of the actuator unit 16, whereby the at least one injection orifice 34 is opened up. If the injection valve 10 is formed as a fuel injection valve, an injection of fuel into a combustion chamber of an internal combustion engine can take place.

When the injection is to be ended, the actuator unit 16 is deactivated, whereby the nozzle needle 18 is moved away from the actuator unit 16 in the axial direction. The nozzle needle 18 thereby passes into a closed position, and the fluid flow through the at least one injection orifice 34 is stopped.

Figure 2:
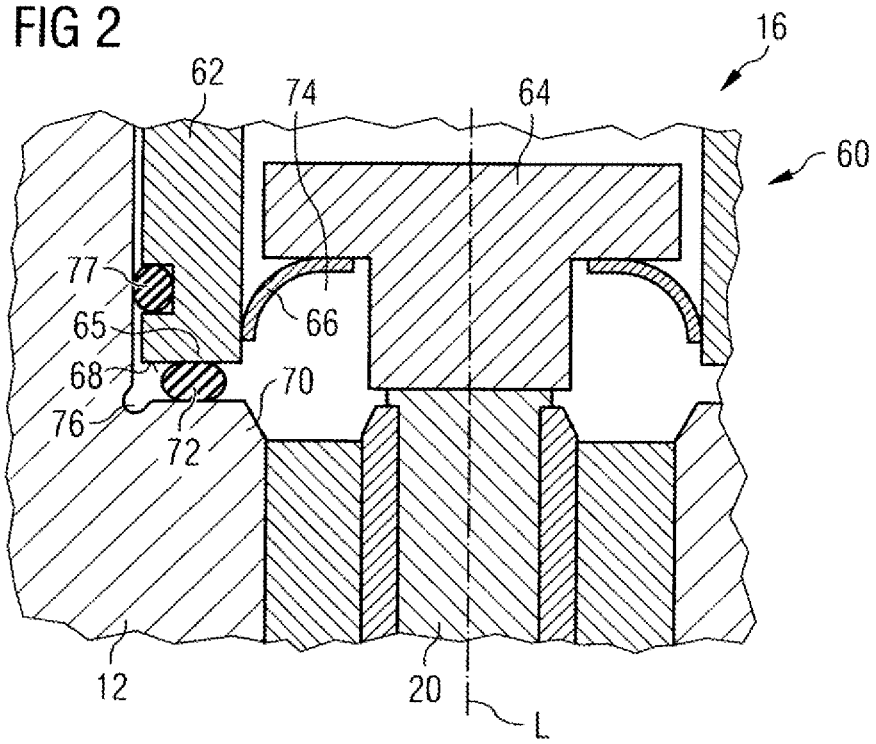
FIG. 2 shows a detail view of the injection valve in a longitudinal section.

FIGS. 1 and 2 illustrate the actuator unit 16 with a tubular actuator housing 60. The stack of piezo elements of the piezo actuator is arranged in the actuator housing 60. The actuator housing 60 is of cylindrical design and extends in the direction of the longitudinal axis L. The actuator housing 60 has a tube casing 62 and a base plate 64. The base plate 64 is arranged at one axial end 65 of the tube casing 62 and therefore of the actuator housing 60. The base plate 64 is coupled in a flexible manner to the tube casing 62 via a diaphragm 66. The base plate 64 is formed from or has a metal.

The actuator housing 60 has, on the axial end 65 facing toward the injection orifice 34, an end surface 68 which mechanically interacts with a step 70 formed in the injector body 12. For this purpose, a ring element 72 is arranged axially between the end surface 68 and the step 70. The ring element 72 is in the shape of a hexagon. The ring element 72 serves to set an idle stroke of the actuator unit 16 in relation to the transmitter 20 in the axial direction, such as arises during the activation of the actuator unit 16, to a predefined value.

Arranged within the ring element 72 is a ring interior space 74. Arranged outside the ring element 72 is a ring exterior space 76. The ring exterior space 76 is sealed off with respect to the environment by means of an O ring seal 77.

A plurality of radially extending passage orifices 78 are arranged in the ring element 72. The passage orifices 78 have a typical width B_1 of 0.5 mm. In the embodiments shown in FIGS. 3 and 4, one of the passage orifices 78 is arranged in each of six sides 80 of the ring element 72. The number of passage orifices 78 is generally at least two and may otherwise be of any desired value. In the embodiments shown in FIGS. 3 and 4, the ring element 72 has a plurality of passage orifices 78 which are arranged point-symmetrically with respect to one another about the longitudinal axis L. The passage orifices 78 are formed as slots or grooves. By means of the passage orifices 78, the ring interior space 74 arranged within the ring element 72 can be hydraulically coupled to the ring exterior space 76 arranged outside the ring element 72. At least two of the passage orifices 78 are situated opposite one another, as a result of which reliable pressure equalization between the ring interior space 74 and the ring exterior space 76 is possible via the passage orifices 78. The pressure profiles in the ring interior space 74 and the ring exterior space 76 can thereby be aligned with one another in a very simple manner.

Figure 3:
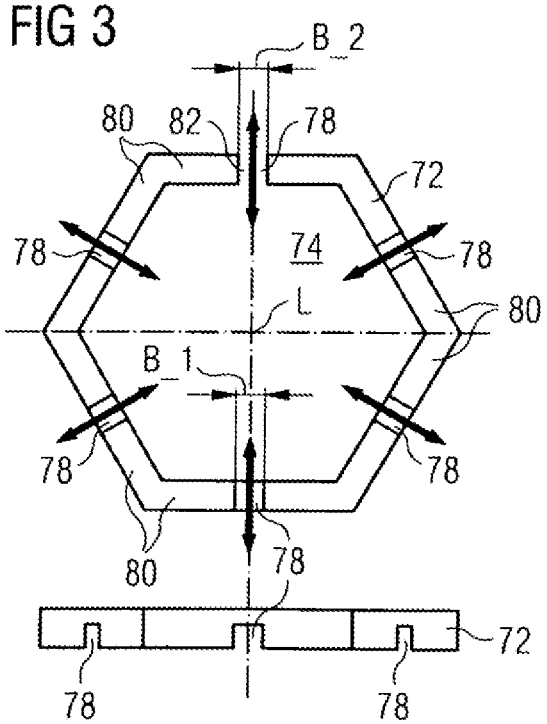
FIG. 3 shows a detail view of a ring element of the injection valve in an example embodiment.
Figure 4:
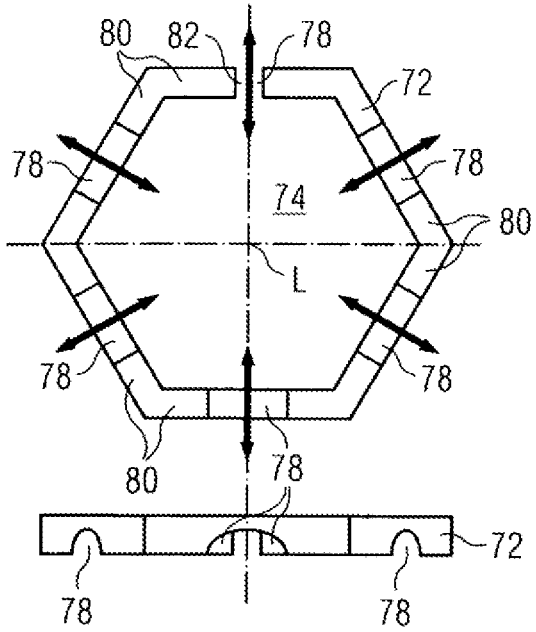
FIG. 4 shows a detail view of the ring element of the injection valve in a further example embodiment.
Figure 5:
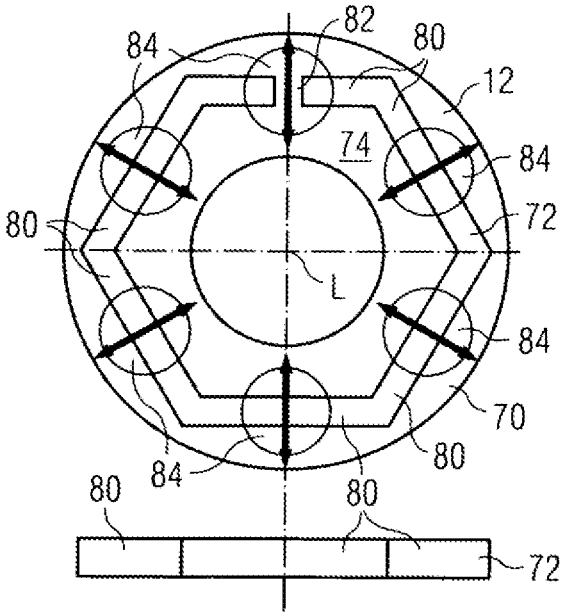
FIG. 5 shows a detail view of the ring element of the injection valve in a further example embodiment.

In the embodiments shown in FIGS. 3, 4 and 5, the ring element 72 is formed from a wire ring. The ring element 72 may be formed from a steel wire. The wire ring is formed such that its ends form a gap 82 with a width B_2 in the ring element 72. The gap 82 is formed as one of the passage orifices 78 between the ring interior space 74 and the ring exterior space 76. The width B_2 is typically at most 0.4 mm.

In the embodiment of the injection valve 10 shown in FIG. 5, at least one radially extending passage recess 84 is arranged in the step 70. The passage recess 84 extends in the radial direction beyond the radial width of the ring element 72. The ring interior space 74 can be hydraulically coupled to the ring exterior space 76 by means of the passage recess 84.

In the embodiment of the injection valve 10 shown in FIG. 5, a plurality of passage recesses 84 is arranged in the step 70, wherein each of the passage recesses 84 is assigned to one of the sides 80 of the hexagonal ring element 72. The passage recesses 84 are in particular arranged point-symmetrically with respect to one another about the longitudinal axis L.

The passage recesses 84 are formed in particular as grooves, as channels, as annular grooves or as blind holes in the injector body 12.

Between two activation phases of the actuator unit 16 formed as a piezo actuator, the hydraulic pressure is the same inside and outside the ring element 72, and therefore also at the O ring seal 77.

During an activation of the actuator unit 16 formed as a piezo actuator, the pressure profiles in the ring interior space 74 and the ring exterior space 76 may differ. The advantage of the passage orifices 78 in the ring element 72 or of the passage recesses 84 in the injector body 12 is basically that, in particular during an activation of the actuator unit 16, a highly effective and fast pressure equalization between the ring interior space 74 and the ring exterior space 76 is possible. It is thereby possible for the time profiles of the pressures in the ring interior space 74 and the ring exterior space 76 to be aligned with one another in a highly effective manner. This can be achieved particularly effectively if the passage orifices 78 in the ring element 72 or the passage recesses 84 are arranged point-symmetrically with respect to the longitudinal axis L, because in this case the pressure in the ring exterior space 76 can be aligned in an effective manner, independently of the azimuth, to the pressure in the ring interior space 74. It may thus be possible for the mechanical loading caused by pressure fluctuations in the injection valve 10, and in particular a loading of components of the injection valve 10 outside the ring exterior space 76, to be kept low. It may thereby also be possible in particular for a mechanical loading of the O ring seal 77 to be kept low, such that frequent exchange of the O ring seal 77 can be avoided. Exchange costs can thereby be reduced or eliminated.

The invention is not restricted to the example embodiments discussed above. For example, the features of the various aspects and embodiments discussed above may be combined with one another, and therefore such arrangements are also encompassed by the invention.

What is claimed is:

1. An injection value,comprising:

an injector assembly comprising:

an injector body which has a recess that extends in a direction of a longitudinal axis of the injector body; and a nozzle needle arranged in an axially movable manner in the recess of the injector body, the nozzle needle configured to prevent a fluid flow through at least one injection orifice when in a dosed position and to otherwise permit the fluid flow;

an actuator unit arranged in the recess of the injector body, the actuator unit comprising an actuator housing in which an actuator element is arranged, the actuator housing having an end surface on an axial end facing towards the injection orifice, the end surface being mechanically coupled to a step formed in the injector body via a ring element arranged axially in a gap defined between the end surface of the actuator housing and the step formed in the injector body;

wherein at least two passage orifices are defined in the ring element at spaced apart locations around a perimeter of the ring element, the at least two passage orifices being arranged opposite one another and extending radially, the at least two passage orifices configured to provide a hydraulic coupling between a ring interior space arranged in the ring element and a ring exterior space arranged outside the ring element; and wherein at locations around the perimeter of the ring element between passage orifices, the ring element fills the gap in the axial direction to maintain the actuator housing axially stationary with respect to the step throughout the operation of the actuator unit.

2. The injection valve of claim 1, wherein at least one of the passage orifices is formed as a slot or groove in the ring element.

3. The injection valve of claim 1, wherein the ring element includes a plurality of passage orifices which arc arranged point-symmetrically with respect to one another about the longitudinal axis.

4. The injection valve of claim 1, wherein the ring element is formed as a hexagon with six sides, and one of the passage orifices is formed in each of the sides of the hexagon.

5. The injection valve of claim 1, wherein:

the ring element comprises a first side in contact with the end surface of the actuator housing and an opposite second side in contact with the step termed in the injector body; and at least one of the passage orifices comprises a notch or groove formed in the first side of the ring element and extending partially toward the second side of the ring element.

6. The injection valve of claim 1, wherein:

the ring element comprises a first side in contact with the end surface of the actuator housing and an opposite second side in contact with the step formed in the injector body; and at least one of the passage orifices comprises a notch or groove formed in the second side of the ring element and extending partially toward the first side of the ring element.

7. The injection valve of claim 1, wherein the ring element comprises exactly one passage orifice.

8. The injection valve of claim 7, wherein the ring element comprises a partial ring having two ends, the passage orifice being defined between the two ends of the partial ring.

9. An injection valve, comprising:

an injector assembly comprising:

an injector body having a recess that extends in a direction of a longitudinal axis of the injector body; and a nozzle needle arranged in an axially movable manner in the recess of the injector body, the nozzle needle configured to prevent a fluid flow through at least one injection orifice when in a closed position and to otherwise permit the fluid flow;

an actuator unit arranged in the recess of the injector body, the actuator body comprising an actuator housing in which an actuator element is arranged, the actuator housing having an end surface on an axial end facing towards the injection orifice, the end surface being mechanically coupled to a step formed in the injector body via a ring element arranged axially between the end surface of the actuator housing and a surface of the step firmed in the injector body, the ring element having a radial width extending from an radially outer ring surface to an radially inner ring surface;

wherein at least one radially extending passage recess is defined in the step, the at least one radially extending passage recess extending in a radial direction across the radial width of the ring and beyond both the radially outer ring surface and the radially inner ring surface, the at least one radially extending passage providing a hydraulic coupling between a ring interior space arranged in the ring element and a ring exterior space arranged outside the ring element.

10. The injection valve of claim 9, wherein a plurality of passage recesses are arranged in the step, the passage recesses being arranged point-symmetrically with respect to one another about the longitudinal axis.

11. The injection valve of claim 9, wherein at least one of the passage recesses is formed as a groove, as a channel, as an annular groove, or as a hole in the step.

12. The injection valve of claim 5, wherein the ring element is formed from a wire ring with a gap, wherein the gap is formed as a passage orifice.

13. The injection valve of claim 9, wherein a plurality of passage recesses are defined around a perimeter of the step.

14. The injection valve of claim 9, wherein:

the ring element comprises a number of side; and a plurality of passage recesses are defined around a perimeter of the step, each passage recess corresponding to one of the sides of the ring element,

15. An injection valve, comprising:

an injector assembly comprising:

an injector body which has a recess that extends in a direction of a longitudinal axis of the injector body; and a nozzle needle arranged in an axially movable manner in the recess of the injector body, the nozzle needle configured to prevent a fluid flow through at least one injection orifice when in a closed position and to otherwise permit the fluid flow;

an actuator unit arranged in the recess of the injector body, the actuator unit comprising an actuator housing in which an actuator element is arranged, the actuator housing having an end surface on an axial end facing towards the injection orifice, the end surface being mechanically coupled to a step formed in the injector body via a hexagonal ring element arranged axially between the end surface of the actuator housing and the step formed in the injector body; and a hydraulic coupling between a ring interior space arranged in the hexagonal ring element and a ring exterior space arranged outside the hexagonal ring element, the hydraulic coupling provided by one of:

a passage orifice defined in each of the six sides of the hexagonal ring element; and a plurality of radially extending passage recess defined in the step, each radially extending passage recess extending in a radial direction across a radial width of one of the sides of the hexagonal ring element.

* * * * *